US006113713A

United States Patent [19]

Blomquist

[11] Patent Number: 6,113,713

[45] Date of Patent: Sep. 5, 2000

[54] REDUCED SMOKE GAS GENERANT WITH IMPROVED MECHANICAL STABILITY

[75] Inventor: Harold R. Blomquist, Gilbert, Ariz.

[73] Assignee: TRW Inc., Lyndhurst, Ohio

[21] Appl. No.: 09/359,005

[22] Filed: Jul. 22, 1999

[51] Int. Cl.[7] ..... C06B 31/00

[52] U.S. Cl. ..... 149/45; 149/19.1

[58] Field of Search ..... 149/19.4, 19.5, 149/19.1, 45, 46, 61

[56] References Cited

U.S. PATENT DOCUMENTS

| | | | |
|---|---|---|---|
| 5,125,684 | 6/1992 | Cartwright | 280/736 |
| 5,498,303 | 3/1996 | Hinshaw et al. | 149/19.6 |
| 5,741,998 | 4/1998 | Hinshaw et al. | 149/19.6 |
| 5,868,424 | 2/1999 | Hamilton et al. | 280/741 |
| 5,962,808 | 10/1999 | Lundstrom | 149/19.1 |
| 6,019,861 | 2/2000 | Canterberry et al. | 149/19.1 |

OTHER PUBLICATIONS

Article, Latypov, N.V., et al., entitled "Synthesis and Reactions of 1,1–diamino–2,2–dinitroethylen," Tetrahedron (1998) in Press.

Article, "Fox–7–A New Explosive with Low Sensitivity and High Performance", Ostmark, et al., FOA, Defence Research Establishment, SE–172 90 Stockholm, Sweden.

*Primary Examiner*—Charles T. Jordan
*Assistant Examiner*—Aileen J. Baker
*Attorney, Agent, or Firm*—Tarolli, Sundheim, Covell, Tummino & Szabo L.L.P.

[57] ABSTRACT

A gas generating composition (16) which when ignited produces gas to inflate a inflatable vehicle occupant protection device (20). The gas generating composition comprises an oxidizer and a fuel. The oxidizer is an inorganic salt. The fuel is 1,1-diamino-2,2-dinitroethylene.

8 Claims, 1 Drawing Sheet

REDUCED SMOKE GAS GENERANT WITH IMPROVED MECHANICAL STABILITY

FIELD OF THE INVENTION

The present invention relates to an apparatus comprising an inflatable vehicle occupant protection device, and particularly relates to a gas generating composition for providing inflation gas for inflating an inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired to help protect a vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

It is desirable that the gas generating material for inflating an inflatable vehicle occupant protection device meet a number of technical requirements. For instance, the gas generated by combustion of the gas generating material should be substantially free of toxic materials. It should also preferably be essentially smoke-free. The gas generating material must be chemically and physically stable over a wide temperature range, and should have ignition and combustion characteristics suitable for use with a vehicle occupant protection device.

The gas generating material preferably contains a fuel which has a favorable oxygen balance. A fuel with a favorable oxygen balance reduces the weight percent of oxidizer needed to oxygen balance the gas generating material and to avoid, upon combustion, excessive production of carbon monoxide.

High energy organic compounds with favorable oxygen balances such as cyclotrimethylenetrinitramine (RDX) and cyclotetramethylenetetranitramine (HMX) have been proposed for use as fuels in gas generating materials for inflators. U.S. Pat. No. 5,125,684 discloses a gas generating material that comprises HMX or RDX, an oxidizer salt, and a cellulose based binder. The advantage of HMX or RDX in the formulation is that gas effluent from combustion of the formulation is smokeless. However, high energy organic compounds with favorable oxygen balances such as HMX or RDX are sensitive to external stimuli including external heat, impact, friction and electrostatic discharge.

SUMMARY OF THE INVENTION

The present invention resides in a gas generating composition which when ignited produces gas to inflate an inflatable vehicle occupant protection device. The gas generating composition comprises an oxidizer and a fuel. The oxidizer is an inorganic salt. The fuel is 1,1-diamino-2,2-dinitroethylene.

BRIEF DESCRIPTION OF THE DRAWINGS

The foregoing and other features of the invention will become more apparent to one skilled in the art upon consideration of the following description of the invention and the accompanying drawing in which.

DESCRIPTION OF PREFERRED EMBODIMENTS

Figure 1:
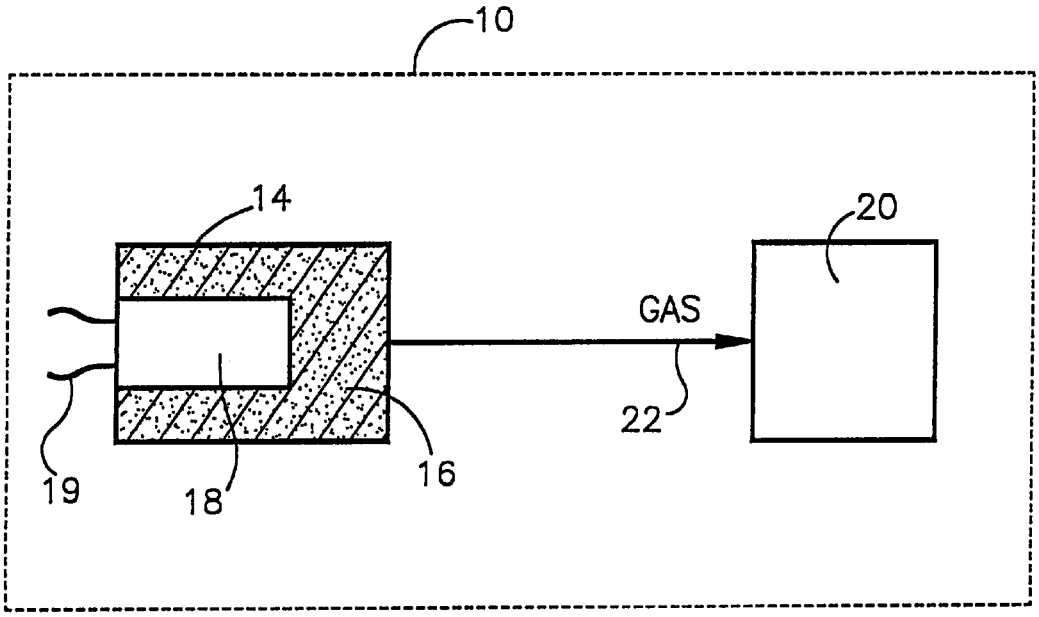
FIG. 1 is a schematic illustration of an apparatus embodying the present invention.

Referring to FIG. 1, an apparatus 10 embodying the present invention comprises an inflator 14. The inflator 14 contains a gas generating composition 16. The gas generating composition 16 is ignited by an igniter 18 operatively associated with the gas generating composition 16. Electric leads 19 convey current to the igniter 18 as part of an electric circuit that includes a sensor (not shown) which is responsive to vehicle deceleration above a predetermined threshold. The apparatus 10 also comprises a vehicle occupant protection device 20. A gas flow means 22 conveys gas, which is generated by combustion of the gas generating composition 16 in the inflator 14, to the vehicle occupant protection device 20.

A preferred vehicle occupant protection device 20 is an air bag which is inflatable to protect a vehicle occupant in the event of a collision. Other vehicle occupant protection devices which can be used in the present invention are inflatable seat belts, inflatable knee bolsters, inflatable air bags to operate knee bolsters, inflatable head liners, and/or inflatable side curtains.

The gas generating composition 16 of the present invention comprises a fuel. The fuel is 1,1-diamino-2,2-dinitroethylene (FOX-7).

1,1-diamino-2,2-dinitroethylene (FOX-7) is obtained from 2-methylimidazole. The reaction scheme of this process is as follows:

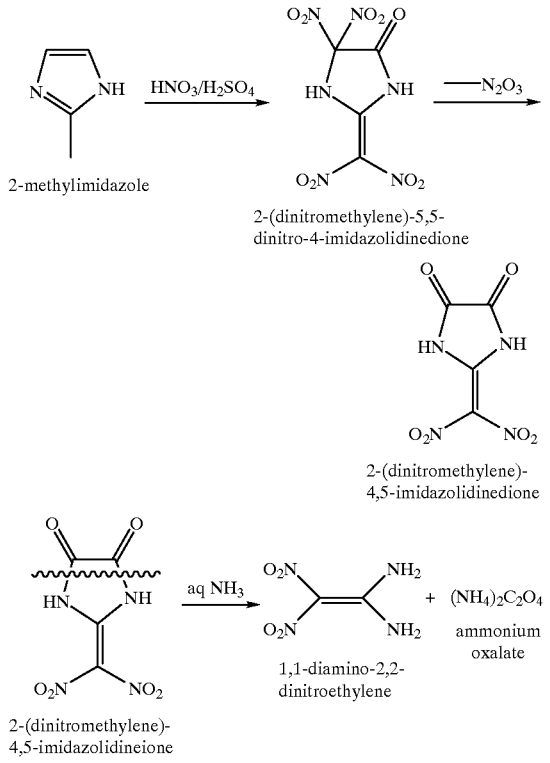

2-Methylimidazole is reacted with a sulfuric acid solution and a nitric acid solution at a temperature of about 15° C. to about 20° C. to form a white precipitate of 2-(dinitromethylene)-5,5-dinitro-4-imidazolidinedione. The precipitate of 2-(dinitromethylene)-5,5-dinitro-4-imidazolidinedione is collected, washed, and dried. On standing at room temperature, the precipitate of 2-(dinitromethylene)-5,5-dinitro-4-imidazoleidinedione decomposes to 2-(dinitromethylene)-4,5-imidazolidinedione. The 2-(dinitromethylene)-4,5-imidazolidinedione is added to an aqueous ammonia solution resulting in quick dissociation and formation of ammonium oxalate and 1,1-diamino-2,2-dinitroethylene.

1,1-diamino-2,2-dinitroethylene (FOX-7) has a molecular weight of 236.1, a density of 0.681 g/cm$^3$, and a melting point of about 180–181° C. It is chemically stable and has the same oxygen balance as cyclotrimethylenetrinitramine (RDX) and cyclotetramethylenetetranitramine (HMX). The burn rate of 1,1-diamino-2,2-dinitroethylene (FOX-7) without oxidizer is similar to cyclotrimethylenetrinitramine (RDX) without oxidizer. The burn rate of 1,1-diamino-2,2-dinitroethylene (FOX-7) without oxidizer is 8,870 m/s versus 8,930 m/s for cyclotrimethylenetetranitramine (RDX) without oxidizer. Furthermore, 1,1-diamino-2,2-dinitroethylene (FOX-7) has a lower impact sensitivity and friction sensitivity compared to cyclotrimethylenetrinitramine (RDX). The impact sensitivity as measured by a 2 kg drop weight apparatus for 1,1-diamino-2,2-dinitroethylene (FOX-7) is 126 cm compared to 38 cm for cyclotrimethylenetrinitramine (RDX). The friction sensitivity as measured with a Julius-Petri friction apparatus is >35 Kp for 1,1-diamino-2,2-dinitroethylene (FOX-7) compared to 12 Kp for cyclotrimethylenetrinitramine (RDX).

The amount of fuel in the gas generating composition 16 is that amount necessary to achieve sustained combustion of the gas generating composition 16. This amount can vary depending upon the particular fuel involved and other reactants. A preferred amount of the fuel is that amount necessary to achieve an oxygen balance with the oxidizer such that the fuel and the oxidizer produce upon combustion a gas product which consists essentially of carbon dioxide, nitrogen, and water. This can be characterized as complete combustion of the fuel. Preferably, the amount of the fuel is in the range of about 30% to about 80% by weight based on the combined weight of the fuel and the oxidizer.

The oxidizer in the gas generating composition of the present invention can be any inorganic oxidizer salt commonly used with a vehicle occupant protection device. A preferred oxidizer is selected from the group consisting of ammonium nitrate (AN), potassium nitrate (KN), sodium nitrate (NaN), potassium perchlorate (KP), ammonium perchlorate (AP), and combinations thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount which is effective to minimize the volumetric and structural changes associated with phase transitions inherent to pure ammonium nitrate. A preferred phase stabilizer is potassium nitrate. Other useful phase stabilizers include potassium salts such as potassium dichromate, potassium oxalate, and mixtures thereof. Ammonium nitrate can also be stabilized by doping with copper and zinc ions. Other compounds, modifiers, and methods that are effective to phase stabilize ammonium nitrate are well known and suitable in the present invention.

The amount of oxidizer in the gas generating composition is that amount necessary to achieve sustained combustion of the gas generating composition. A preferred amount of oxidizer is in the range of about 20% to about 70% by weight based on the combined weight of the oxidizer and the fuel.

The gas generating composition of the present invention preferably includes a binder. Suitable binders for gas generating compositions are well known in the art. Preferred binders include cellulose based binders, polycarbonates, polyurethanes, polyesters, polyethers, polysuccinates, thermoplastic rubbers, polybutadiene, polystyrene, and mixtures thereof.

A preferred amount of binder is in the range of 0 to about 10% by weight based on the weight of the gas generating composition. More preferably the amount of binder is in the range of about 2.5% to about 5% by weight based on the weight of the gas generating composition.

The gas generating composition may comprise a coolant. A preferred coolant is a metal oxide such as aluminum oxide ($Al_2O_3$). Metal oxides also act as sinter forming materials which bind to and form solid residue with caustic materials that may be generated upon combustion of the gas generating composition. The solid residue so formed is more easily filtered during inflation of the vehicle occupant protection device. The coolant may be present in the range of about 10% to about 25% by weight based on the weight of the gas generating composition.

The present invention may also comprise other ingredients commonly added to a gas generating composition for providing inflation gas for inflating an inflatable vehicle occupant protection device, such as plasticizers, process aids, burn rate modifiers, and ignition aids, all in relatively small amounts.

EXAMPLE 1

A gas generating composition is prepared by combining, in a conventional powder mixing device, powdered 1,1-diamino-2,2-dinitroethylene (FOX-7) and powdered reagent grade ammonium nitrate (AN) in a weight ratio of about 1:1. Prior to mixing, the powders are passed through a fifty mesh screen. The weight ratio of about 1:1 is selected for substantially complete combustion of the gas generating composition to a gas consisting essentially of carbon dioxide, nitrogen, and water.

After combining the 1,1 diamino-2,2-dinitroethylene (FOX-7) and ammonium nitrate (AN), the mixture of 1,1-diamino-2,2-dinitroethylene (FOX-7) and ammonium nitrate (AN) is compacted under a compaction pressure of 11,000 ft-lb (1521 kg-m) into tablets having a diameter of approximately 1.3 cm, a thickness of 0.73 cm, and a density of 0.783 g/cm$^3$.

Thermochemical calculations for the combustion of the tablets of the gas generating composition were performed using an initial combustion temperature of 298 K, a chamber pressure of 2000 psi and an exhaust pressure of 14.7 psi. The thermochemical calculation results are given in Table 1.

TABLE 1

| | |
|---|---|
| FOX-7 wt % | 51.9 |
| AN wt % | 48.1 |
| T flame, K | 2734 |
| Impetus chamber, lbfts/lbm | 363,139 |
| T exhaust, K | 1222 |
| Impetus exhaust, lbfts/lbm | 184,021 |

Example 1 contains by weight of the gas generating composition 51.9% 1,1-diamino-2,2-dinitroethylene (FOX-7) and 48.1% ammonium nitrate (AN). The flame temperature, exhaust temperature, and impetus are all within acceptable performance specifications for a gas generating composition used with a vehicle occupant protection device.

Comparative Example 1

A gas generating composition is prepared comprising cyclotrimethylenetrinitramine (RDX) and reagent grade ammonium nitrate (AN) in a weight ration of about 1:1. This ratio is selected for substantially complete combustion of the fuel to a gas consisting essentially of carbon dioxide, nitrogen, and water.

The RDX and AN are prepared separately as powders, screened, mixed, and compacted into tablets as in Example 1. Thermochemical calculation results for the combustion of the tablets are listed in the following Table 2 along with results for Example 1 for purposes of comparison.

TABLE 2

| | Comp. EX 1 | EX 1 |
|---|---|---|
| FOX-7 wt % | — | 51.9 |
| RDX wt % | 51.9 | |
| AN wt % | 48.1 | 48.1 |
| T flame, K | 2914 | 2734 |
| Impetus chamber, lbfts/lbm | 390,957 | 363,139 |
| T exhaust, K | 1373 | 1222 |
| Impetus exhaust, lbfts/lbm | 184,021 | 164,898 |

Table 2 shows that the FOX-7 and AN composition requires the same amount of ammonium nitrate for complete combustion as the RDX and AN composition. However, the FOX-7 and AN composition has a substantially lower flame temperature and exhaust temperature (i.e. >100 K) than the RDX and AN composition. This lower flame temperature and exhaust temperature of the FOX-7 and AN composition can be attributed to FOX-7 having a lower heat of formation than RDX. A lower heat of formation causes a fuel, upon combustion, to produce less energy in the form of heat.

EXAMPLES 2–7

In Examples 2–7 the fuel is 1,1-diamino-2,2-dinitroethylene (FOX-7) and the oxidizers are, respectively, potassium perchlorate (KP) (Example 2), ammonium nitrate (AN) phase stabilized with about 15% potassium nitrate (KN) (Example 3), and ammonium perchlorate (AP) mixed with sodium nitrate (NaN) (Examples 4–7). Binders have also been added to the formulations of Examples 5–7. The formulations and thermochemical calcualtion results for the combustion of Examples 2–7 are given in Table 3.

TABLE 3

| | EX 2 | EX 3 | EX 4 | EX 5 | EX 6 | EX 7 |
|---|---|---|---|---|---|---|
| FOX-7 wt % | 76.1 | 51.5 | 64.6 | 47.5 | 33.4 | 30.3 |
| AN wt % | — | 44 | — | — | — | — |
| KN wt % | — | 7.8 | — | — | — | — |
| NaN wt % | — | — | 14.8 | 19.9 | 25.9 | 25.1 |
| AP wt % | — | — | 20.5 | 27.6 | 35.7 | 34.6 |
| KP wt % | 23.9 | — | — | — | — | — |
| CAB wt % | — | — | — | 2.5 | — | 5.0 |
| TBC wt % | — | — | — | 2.5 | — | 5.0 |
| Kraton wt % | — | — | — | — | 5.0 | — |

TABLE 3-continued

| | EX 2 | EX 3 | EX 4 | EX 5 | EX 6 | EX 7 |
|---|---|---|---|---|---|---|
| T flame, K | 3152 | 2734 | 3016 | 2908 | 2830 | 2734 |
| Impetus chamber, lbfts/lbm | 356,355 | 345,530 | 349,709 | 327,821 | 312,163 | 363,139 |
| T exhaust, K | 1487 | 1299 | 1551 | 1462 | 1433 | 1222 |
| Impetus exhaust, lbfts/lbm | 165,637 | 163,361 | 174,672 | 161,275 | 154,283 | 164,898 |

Referring to Table 3, Example 2 contains by weight of the gas generating composition 76.1% 1,1-diamino-2,2-dinitroethylene (FOX-7) and 23.9% potassium perchlorate (Kp) for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Example 3 contains by weight of the gas generating composition 51.5% 1,1-diamino-2,2-dinitroethylene (FOX-7), and 44% ammonium nitrate(AN) phase stabilized with 7.8% potassium nitrate (KN) for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Example 4 contains by weight of the gas generating composition 64.6% 1,1-diamino-2,2-dinitroethylene (FOX-7), 20.5% ammonium perchlorate (AP) and 14.8% sodium nitrate (NaN) for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Example 5 contains by weight of the gas generating composition 47.5% 1,1-diamino-2,2-dinitroethylene (FOX-7), 27.6% ammonium perchlorate (AP), 19.9% sodium nitrate (NaN), 2.5% cellulose acetate butyrate (CAB), and 2.5% tributyl citrate (TBC) for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Example 6 contains by weight of the gas generating composition 33.4% 1,1-diamino-2,2-dinitroethylene (FOX-7), 35.7% ammonium perchlorate (AP), 25.9% sodium nitrate (NaN), and 5% Kraton for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Example 7 contains by weight of the gas generating composition 30.3% 1,1-diamino-2,2-dinitroethylene (FOX-7), 34.6% ammonium perchlorate (AP), 25.1% sodium nitrate (NaN), 5% cellulose acetate butyrate (CAB), and 5% tributyl citrate (TBC) for substantially complete combustion of the carbon atoms in 1,1-diamino-2,2-dinitroethylene (FOX-7) to carbon dioxide. The flame temperature, exhaust temperature, and impetus are all within acceptable performance specifications for a gas generating composition used with a vehicle occupant protection device.

Comparative Examples 2–7

Comparative Examples 2–7 have the same formulations as Examples 2–7 except that the FOX-7 fuel in Examples 2–7 has been replaced with equivalent amounts of cyclotrimethylenetrinitramine (RDX). The formulations and thermochemical calculations for the combustion of Comparative Examples 2–7 are given in Table 4.

TABLE 4

| | Comp. EX 2 | Comp. EX 3 | Comp. EX 4 | Comp. EX 5 | Comp. EX 6 | Comp. EX 7 |
|---|---|---|---|---|---|---|
| RDX wt % | 76.1 | 51.5 | 64.6 | 47.5 | 33.4 | 30.3 |
| AN wt % | — | 44 | — | — | — | — |
| KN wt % | — | 7.8 | — | — | — | — |
| NaN wt % | — | — | 14.8 | 19.9 | 25.9 | 25.1 |
| AP wt % | — | — | 20.5 | 27.6 | 35.7 | 34.6 |
| KP wt % | 23.9 | — | — | — | — | — |
| CAB wt % | — | — | — | 2.5 | — | 5.0 |
| TBC wt % | — | — | — | 2.5 | — | 5.0 |
| Kraton wt % | — | — | — | — | 5.0 | — |
| T flame, K | 3405 | 2932 | 3225 | 3077 | 2959 | 2906 |
| Impetus chamber, lbfts/lbm | 397,016 | 375,040 | 383,122 | 352,631 | 329,918 | 321,657 |
| T exhaust, K | 1761 | 1403 | 1787 | 1617 | 1525 | 1471 |
| Impetus exhaust, lbfts/lbm | 195,940 | 178,266 | 200,986 | 179,092 | 165,286 | 159,086 |

Referring to Table 4, Comparative Examples 2–7 show that the RDX formulations require the same amount of oxidizer as the respective FOX-7 formulations to provide for complete combustion of the RDX. However, as indicated above, the flame temperatures and exhaust temperatures of the RDX formulations are at least about 100 K higher.

Advantages of the present invention should now be apparent. Primarily, the present invention takes advantage of the favorable performance characteristics of using 1,1-diamino-2,2-dinitroethylene (FOX-7) as a fuel with an inorganic salt oxidizer. A mixture of the inorganic salt oxidizer and 1,1-diamino-2,2-dinitroethylene (FOX-7) offers improved mechanical stability without sacrificing chemical stability. Furthermore, the gas generating composition of the present invention produces an improved gas product which is essentially non-toxic and free of particulates. The improvements in mechanical stability and quality of the gas product result from the use of a fuel which has a low impact and friction sensitivity as well as favorable oxygen balance. Moreover, gas generating compositions with 1,1-diamino-2,2-dinitroethylene (FOX-7) as the fuel have lower flame and exhaust temperatures when compared to gas generating compositions using cyclotrimethylenetrinitramine (RDX) as the fuel.

From the above description of the invention, those skilled in the art will perceive improvements, changes, and modifications. Such improvements, changes and modifications within the skill of the art are intended to be covered by the appended claims.

Having described the invention, the following is claimed:

1. A gas generating composition which when ignited produces gas to inflate an inflatable vehicle occupant protection device comprising an oxidizer, and a fuel, wherein said oxidizer is an inorganic salt and said fuel is 1,1-diamino-2,2-dinitroethylene.

2. The gas generating composition as defined in claim 1 wherein said oxidizer is selected from the group consisting of ammonium nitrate, potassium nitrate, potassium perchlorate, ammonium perchlorate, and combinations thereof.

3. The gas generating composition as defined in claim 2 wherein said oxidizer is ammonium nitrate and said ammonium nitrate is phase stabilized.

4. The gas generating composition as defined in claim 1 wherein the gas generating composition further comprises a binder.

5. The gas generating composition as defined in claim 4 wherein said binder is selected from the group consisting of cellulose based binders, polycarbonates, polyurethanes, polyesters, polyethers, polysuccinates, thermoplastic rubbers, polybutadiene, polystyrene, and mixtures thereof.

6. The gas generating composition as defined in claim 1 wherein the amount of fuel is about 30% to about 80% by weight of the combined weight of said fuel and said oxidizer.

7. The gas generating composition as defined in claim 1 wherein the amount of oxidizer is about 20% to about 70% by weight of the combined weight of said fuel and said oxidizer.

8. An apparatus comprising an inflatable vehicle occupant protection device and a gas generating composition which when ignited produces gas to inflate said inflatable vehicle occupant protection device, said gas generating composition comprising an oxidizer, and a fuel, wherein said oxidizer is selected from the group consisting of ammonium nitrate, potassium nitrate, potassium perchlorate, ammonium perchlorate, and combinations thereof and wherein said fuel is 1,1-diamino-2,2-dinitroethylene.

* * * * *